US006637233B1

(12) United States Patent
Flum

(10) Patent No.: US 6,637,233 B1
(45) Date of Patent: Oct. 28, 2003

(54) PRODUCT MERCHANDISING UNIT WITH VARIABLE SELECTABLE PRODUCT CAPACITY

(75) Inventor: Paul L. Flum, Clayton, MO (US)

(73) Assignee: Paul Flum Ideas, Inc., St. Louis, MO (US)

( * ) Notice: Subject to any disclaimer, the term of this patent is extended or adjusted under 35 U.S.C. 154(b) by 0 days.

(21) Appl. No.: 10/064,696

(22) Filed: Aug. 7, 2002

Related U.S. Application Data

(63) Continuation-in-part of application No. 29/162,889, filed on Jun. 24, 2002.

(51) Int. Cl.[7] ..... F25D 3/08; B65D 6/28; F17C 1/08

(52) U.S. Cl. ..... 62/371; 62/264; 62/457.2; 220/529; 220/625; 220/592.2

(58) Field of Search ..... 62/371, 372, 264, 62/457.1, 457.2; 220/625, 629, 529, 592.2

(56) References Cited

U.S. PATENT DOCUMENTS 3,679,047 A * 7/1972 Papirnyik ..... 206/39.5
4,307,581 A * 12/1981 Reid ..... 62/457.1
4,515,421 A * 5/1985 Steffes ..... 312/351
5,048,305 A * 9/1991 Taub ..... 62/372
5,299,711 A * 4/1994 Romick ..... 221/2
5,433,085 A 7/1995 Rogers ..... 62/372
5,596,880 A * 1/1997 Welker et al. ..... 62/372
5,910,162 A * 6/1999 Harbour et al. ..... 62/246
5,912,033 A * 6/1999 Ferguson ..... 426/124
6,478,268 B1 * 11/2002 Bidwell et al. ..... 248/174
2001/0035366 A1 * 11/2001 Purvis ..... 206/459.5
2002/0148795 A1 * 10/2002 Miller et al. ..... 211/88.01

* cited by examiner

*Primary Examiner*—William C. Doerrler
(74) *Attorney, Agent, or Firm*—Blackwell Sanders Peper Martin LLP

(57) ABSTRACT

A product merchandising display unit having selectable product capacity including a receptacle having an internal cavity adapted for receiving and holding a quantity of product, and a product support floor member positionable at any one of at least two different elevated locations within the internal cavity for varying the product holding capacity thereof. A plurality of shoulder portions are located at each of the at least two different elevated locations within the internal cavity, the shoulder portions located at each spaced location being engageable with at least some of the peripheral edge portions associated with the floor member when the floor member is oriented in one of at least two different orientations. The display unit also includes a lid member having spaced pairs of retaining projections associated therewith for displaying advertising indicia therethrough.

16 Claims, 3 Drawing Sheets

PRODUCT MERCHANDISING UNIT WITH VARIABLE SELECTABLE PRODUCT CAPACITY

CROSS REFERENCE TO RELATED APPLICATIONS

This application is a continuation-in-part of U.S. Design application Ser. No. 29/162,889 filed Jun. 24, 2002 entitled PRODUCT MERCHANDISING COOLER.

BACKGROUND OF INVENTION

The present invention relates generally to product merchandising display devices for use in storing and displaying for sale products or articles such as bottled or canned soft drink beverages, juices and the like and, more particularly, to various embodiments of a product merchandising display unit adaptable for use in merchandising chilled products wherein such unit includes an internal cavity or receptacle for receiving and holding both a quantity of ice and chilled products positioned therein and a product support structure or floor member which is selectably adjustably positionable at any one of a plurality of different locations within the internal cavity of the unit for varying the product holding capacity of the display unit. The adjustable product support floor member is particularly advantageous because such floor member can be positioned at the proper elevation within the unit to support a particular quantity of product and ice near the top of the unit for easy access by the customer, and such adjustability also provides for a more attractive display.

In the merchandising of single unit articles such as bottled or canned soft drink and juice type beverages and, particularly, those impulse items that are desired pre-chilled by customers and are normally sold in single units at food counters, points of purchase, and other high customer traffic locations, it is desirable for product display units or containers for merchandising such articles to have a sufficient volume to hold enough product and ice to satisfy periods of high consumer demand, such as on weekends, holidays, and other high consumer traffic periods, yet, at the same time, be adaptable to hold a smaller quantity of such articles and ice for lower sales volume periods. If a large capacity container is completely filled with ice and articles for sale during low sales volume periods, the ratio of the amount of ice used to articles sold will be high thereby raising the cost per article sold. If a large capacity container is only partially filled with ice and product for sale during low sales volume periods, the display will not be as attractive and inviting, and the articles positioned therein will be harder to access since they will not be located near the top of the container for easy removal. Conversely, if a container having a volume suitable for lower sales volume periods is stocked with product and used during higher sales volume periods, the container will require more frequent refilling of product.

Another disadvantage to using a container having a product capacity larger than that required for anticipated sales is that, if the container is filled with ice and articles for sale so as to have an initially attractive appearance, as the ice melts the articles will gradually become immersed in cold water. This necessitates reaching into the cold water to retrieve the articles which can be uncomfortable and can cause consumers to select an article for sale from a different, more inviting display. Such an arrangement can also be unattractive depending upon the amount of melted ice within the container. In this regard, germs on customer's hands can be released into the water when customers reach therein to obtain an article.

Various means have been designed to alleviate some of the above-described problems but such means still suffer from certain disadvantages and shortcomings. For example, U.S. Pat. No. 5,433,085 discloses one attempt to achieve a variable capacity container by providing a display container utilizing a float upon which ice and articles for sale can be supported above waste water that collects under the float as the ice melts. A limitation of this device, however, is that no other means are provided for supporting the float at a higher position in the container and if the container is sufficiently large to provide the capacity needed for high sales volume periods, then, if the container is used for lower sales volume periods, the container must be either filled to capacity with articles for sale and ice on top of the float, or such container must be filled with water below the float in order to elevate the float to the extent necessary to raise a smaller amount of product for sale to the top of the container.

Reference also U.S. Pat. No. 5,048,305 which discloses a cooler assembly having a lower sump zone comprised of strut-like spacers which are disposed in an array and provide support to the articles for sale and ice positioned above the waste water while the water collects between the spacers. Shortcomings of this construction include the fact that the spacers are still relatively short and such spacers cannot be raised sufficiently high enough to substantially reduce the container volume. In other words, even with the strut-like spacers, the container volume still remains large. Also, these strut-like spacers are time consuming and difficult to clean and disinfect.

U.S. Pat. No. 5,910,162, which patent is assigned to the present assignee, Paul Flum Ideas, Inc. of St. Louis, Mo. discloses several embodiments of a product merchandising unit having variable/selectable product capacity. Although these constructions achieve the desired objective of the present invention, the present invention differs therefrom in that it is specifically directed to a trapezoidally shaped unit having features different from those features disclosed in U.S. Pat. No. 5,910,162.

For these and other reasons, the present invention is directed to overcoming one of more of the problems set forth above.

SUMMARY OF INVENTION

The present invention overcomes many of the shortcomings and limitations of the prior art devices discussed above and teaches the construction and operation of several embodiments of a product merchandising display device adaptable for use in merchandising chilled products having a product support structure selectably positionable therein to enable the unit to hold and display selectable or variable amounts of product for sale along with a desired quantity of ice. The present unit, regardless of the selected capacity, provides an attractive, inviting display in which the articles for sale are made conveniently accessible to the consumer at the top of the unit, and such unit is also easy to restock. In addition, when a smaller product capacity is selected, the unused portion of the present unit beneath the adjustable product support floor member can be utilized as a basin for collecting waste water from the melted ice so that the articles for sale along with the ice are consistently supported above the waste water level and consumers can access the chilled articles without immersing their hands in cold water. Although the present unit is primarily designed for use in merchandising chilled products, such unit can likewise be equally employed for use in merchandising non-chilled products as well.

The present product merchandising unit comprises a container assembly which includes an outer body member and an inner tub member or other receptacle having an internal cavity associated therewith adapted for receiving and holding beverage products or other articles for sale and a quantity of ice for chilling such products or articles if so desired. Although the outer body member of the present assembly is preferably rectangular or trapezoidal, other container shapes and configurations such as a square, and a triangular configuration will likewise work well as will be hereinafter explained. The tub member or other receptacle is typically cooperatively engageable with the upper edge portion of the outer body member, although other means for holding the tub member within the body member may likewise be utilized. The tub member may also be integrally formed with the outer body member and includes an opened upper end portion, a lower or bottom end portion forming the bottom surface of the tub member, and a sidewall extending between the upper and lower end portions thereof defining an internal cavity therebetween. The tub member, in its preferred form, is substantially trapezoidal in shape and includes an integral reservoir at the bottom portion of the tub member, the integrally formed reservoir being capable of holding a substantial liquid capacity and further including drain means associated with the lower bottom portion thereof for allowing the melted ice or waste water to escape therefrom. A substantially flat removably adjustable product support floor member or reservoir plate is located immediately above the reservoir portion of the tub member intermediate the top and bottom portions thereof and separates the reservoir from the product holding portion of the tub. The tub member is shaped and sized to fit within the outer body member and is either supported by the outer body member or integrally formed therewith.

To effect changing the interior capacity of the tub member, the floor member is positionable so as to rest upon and/or be supported by any one of a different plurality of spaced steps or shoulder portions located on the interior surface of the tub sidewall intermediate the top and bottom end portions thereof, each plurality of shoulder portions being located at different height levels within the interior cavity of the tub member. The product support floor member is a planar member, slightly smaller in dimensional expanse as compared to the expanse of the internal cavity of the tub member so as to be readily and easily maneuverable and positionable therein, and includes a plurality of projections or ears which are located and positioned adjacent the peripheral edge portion thereof so as to engage and/or rest upon the appropriate plurality of shoulder portions at a selected location within the tub member to achieve the desired product capacity. The present shoulder portions or other tub member prominences can be integrally formed as part of the tub inner sidewall, or such shoulder portions can be permanently affixed or detachably attached to the tub sidewall or other support structure by any suitable manner such as by mechanical attachment means, frictional attachment means, adhesives, and other similar means. Although it is preferred that the product support floor member be supported and maintained at the selected locations by the present shoulder portions or other equivalent prominences, it is also recognized that the present product support floor member can be supported and maintained at the various selected locations within the tub member in a wide variety of different ways including, but not limited to, using a plurality of hooks, knobs, buttons or other prominences positioned adjacent the inner tub sidewall adaptable for cooperatively engaging and/or supporting the product support floor member, or using frictional engagement between the product support floor member and the inner sidewall of the tub member.

Regardless of the product support floor member selected, it is desirable that some communication be provided between the product holding portion of the tub member located above the product support floor member and the reservoir portion located below the floor member to allow passage of melt water from the product portion of the tub member to the reservoir. This communication can be achieved through the use of at least one hole or passageway extending through or around the product support structure. Additionally, it is advantageous that a single product support member be usable at all elevated locations within the tub member, although it is likewise recognized that different product support members may be used at the different elevations with equal utility. Similarly, it is further recognized that the shape and configuration of the present tub member can likewise take on a wide variety of different sizes and shapes so as to be compatible with the shape of the outer body member.

The present tub member may also include insulation material which is positioned to surround and insulate the bottom and sides of the tub member. Any suitable insulation such as a foam type insulation may be used to insulate the chilling tub so as to keep the articles placed therein cold for as long as possible. Plastic tubing or other tube means may likewise be connected to the drain means associated with the reservoir portion of the tub member and may be fed through a hole located on one side of the outer body member to the exterior thereof. Clamp means may be positioned on the terminal end portion of the drain tube to control removal of the waste water from the reservoir means, or the drain tube may be connected to a spigot for likewise accomplishing waste water removal. This provides a simple and easy means for emptying the reservoir without having to unload or move the tub member from the overall assembly. The present tub member may likewise be suitably provided with means to accommodate a see-through lid member which is designed to rest upon and/or be attached to the upper portion of the tub member. The lid member serves to close the tub member, provides visibility of its contents, and provides ready access to the articles therein by customers. Lid members of various shapes and styles may also be used in conjunction with the present tub members. Further, in some embodiments, the lid member includes means for holding and displaying visual information such as promotional advertisements for promoting the products displayed within the tub member. In one embodiment, the advertisements are presented by way of printed cards or graphic panels that are associated with the lid member. Front and rear wheels are also optionally provided on a bottom portion of the unit to facilitate moving the unit from one merchandising location to another.

BRIEF DESCRIPTION OF DRAWINGS

These and other inventive features and advantages appear from the following Detailed Description when considered in connection with the accompanying drawings in which similar reference characters denote similar elements throughout the several views.

DETAILED DESCRIPTION

For illustration purposes only, the following various embodiments of the present product merchandising display unit including the various present tub members having selectable product capacity used in association therewith are described and disclosed herein as trapezoidal shaped members. It is anticipated and recognized, however, that chilled beverage display containers with selectable product capacity constructed according to the teachings of the present invention can likewise be fashioned into a variety of different sizes and shapes as previously explained and that internal components of the present assemblies such as the adjustable floor member may likewise be correspondingly shaped to conform to the shape of the overall assembly without departing from the teachings and practice of the present invention.

Figure 1:
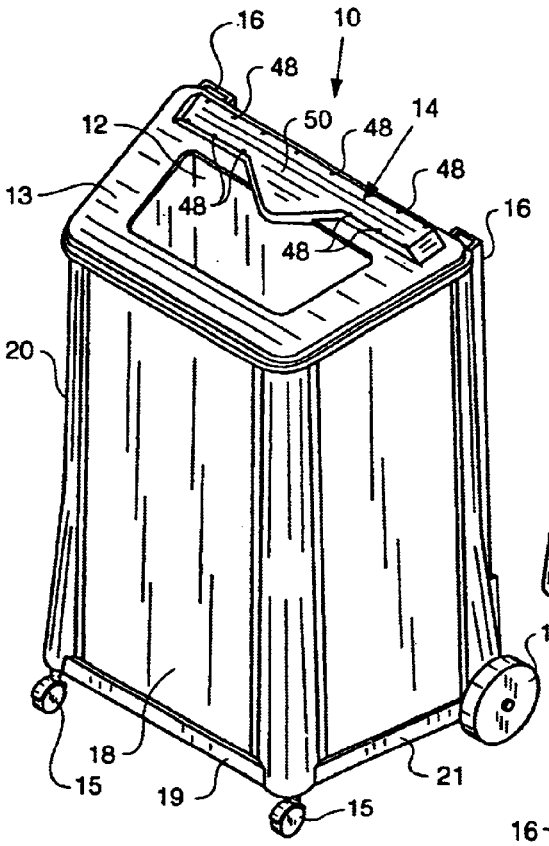
FIG. 1 is a perspective view of a product merchandising display unit constructed in accordance with the teachings of the present invention.
Figure 6:
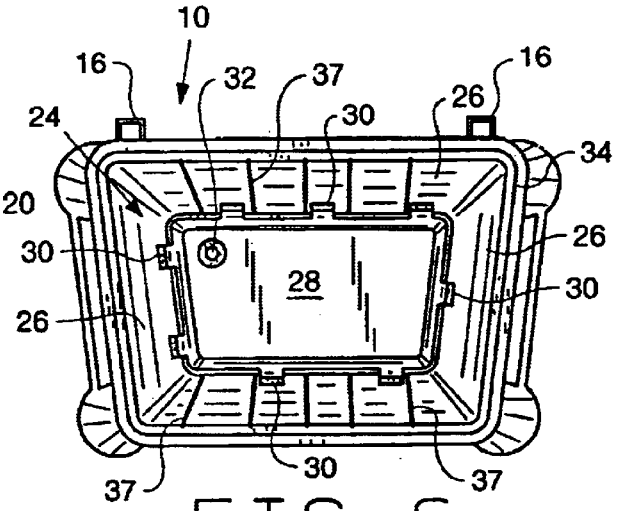
FIG. 6 is a top plan view of the display unit of FIG. 1 with the lid member and interior floor member removed.
Figure 10:
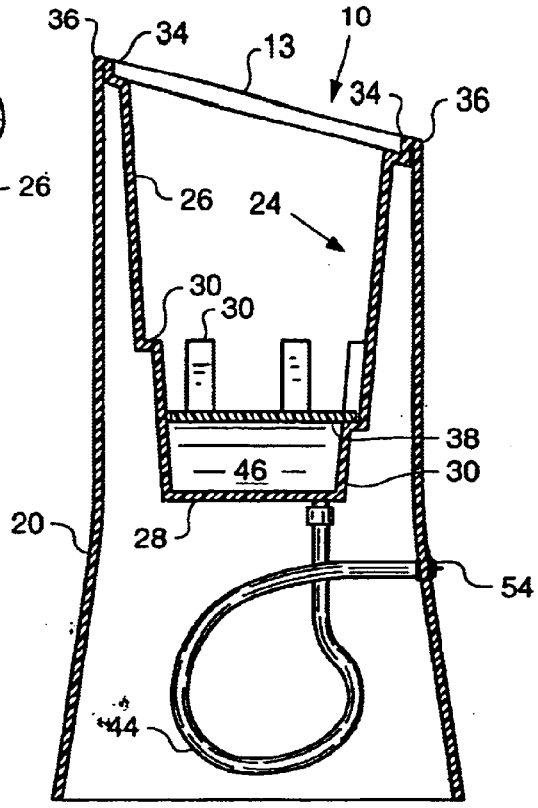
FIG. 10 is a sectional side elevational view of the display unit of FIG. 1 showing the interior floor member installed in a lower position.
Figure 11:
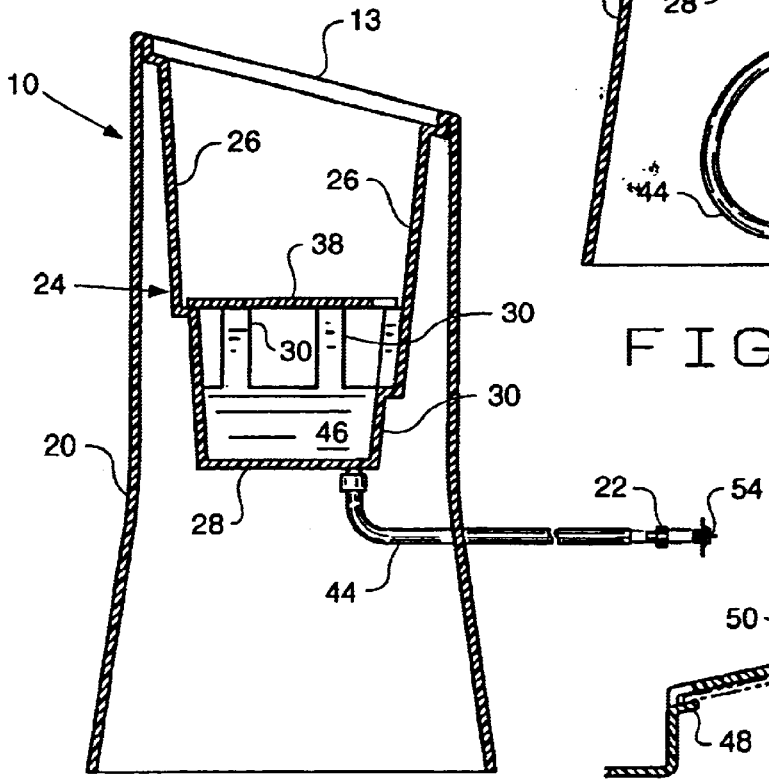
FIG. 11 is a sectional side elevational view of the display unit of FIG. 1 showing the interior floor member installed in an upper position.

Referring to the drawings more particularly by reference numbers wherein like numerals refer to like parts, the numeral 10 in FIG. 1 identifies a product merchandising display unit constructed according to the teachings of the present invention. The product merchandising unit 10 comprises a generally hollow trapezoidal shaped outer body member 20 of conventional construction having optional rear wheels 11 and front casters 15. The product merchandising device also has a correspondingly shaped tub member 24 as best illustrated in FIGS. 10 and 11 and a separate floor member 38 as best illustrated in FIGS. 6, 10 and 11, the tub member 24 including means for selectably positioning the floor member 38 at various elevations within the tub member for adjustably varying the product capacity thereof as will be hereinafter further discussed. An upper edge portion 36 of the outer body member 20 as best illustrated in FIG. 10 cooperatively receives and holds the present tub member 24 as will be likewise hereinafter explained.

Referring again to FIG. 1, the product merchandising unit 10 includes a lid member 13 having a window or opening 12 associated therewith, the lid member 13 also preferably including a display holder 14 which includes means for optionally holding and displaying to consumers graphic panels or other printed display cards or advertising materials for promoting the products being merchandised within the display unit 10. The unit 10 also includes hollow or tubular members 16 which are operable to receive supports or other elongated members (not shown) that are adapted to support a vertical display of printed advertising materials or other indicia for again promoting the products being merchandised within the display unit 10. A front portion 18 of the product merchandising unit 10 includes support member 19 which optionally provides reinforcing structure to the outer body 20. Side reinforcing structures 21 provide similar functions to side portions of the product merchandising unit 10.

Figure 2:
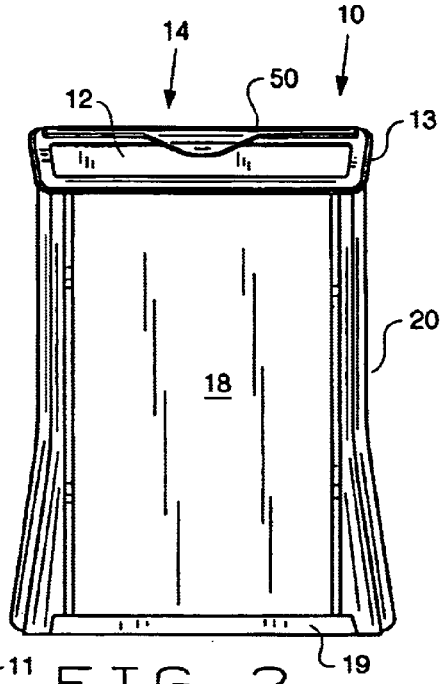
FIG. 2 is a front elevational view of the display unit of FIG. 1.

FIG. 2 is a front elevational view of the display unit 10. From this perspective, the display holder 14 and the window or opening 12 are viewable. In one embodiment, the window 12 is adapted to allow a consumer to observe the contents of the product merchandising unit 10 without opening the lid member 13. Once the selection process is completed, the lid member 13 can be raised to remove the product. On the other hand, the lid member 13 can be attached to the unit 10 so as not to be repeatedly openable to select product from the interior thereof. In this configuration, the lid member 13 includes an opening 12, not a window, so that a consumer can merely reach into the interior of the unit 10 through opening 12.

Figure 3:
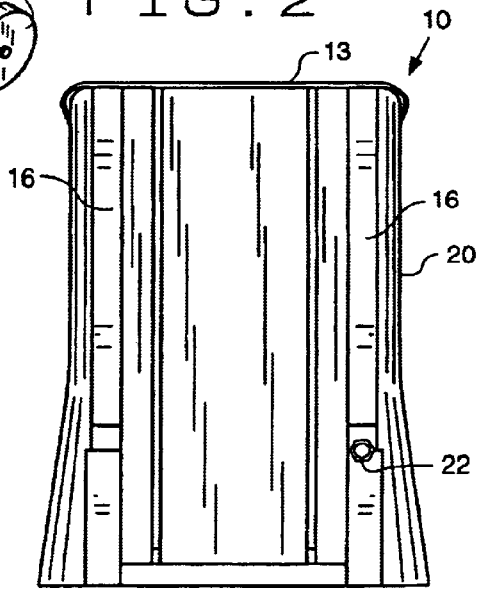
FIG. 3 is a rear elevational view of the display unit of FIG. 1.

FIG. 3 is a rear elevational view of the display unit 10 showing the positioning of an adjustable drain apparatus 22 that facilitates removal of waste water from within the tub member 24. The adjustable drain apparatus 22 optionally fits into a recess in a rear portion of the unit 10. The adjustable drain apparatus 22 is further discussed in connection with FIGS. 10 and 11 below.

Figure 4:
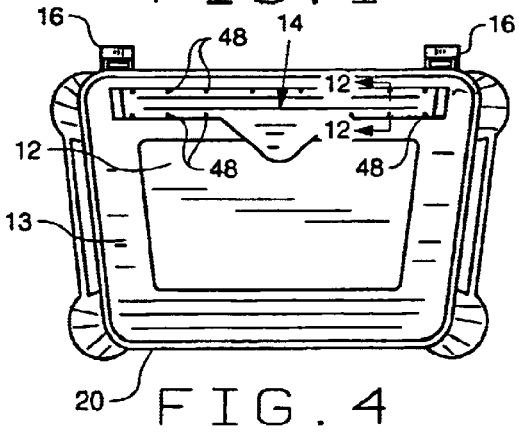
FIG. 4 is a top plan view of the display unit of FIG. 1.

FIG. 4 is a top plan view of the display unit 10 showing the lid member 13 in operable position on top of the outer body member 20. The display holder 14 includes a plurality of spaced retaining projections 48 which are better shown and further described in connection with FIG. 12 below. The hollow or tubular members 16 are operable to receive support frame members, polls or other elongated members associated with a vertical display or other promotional signage (not shown) that can be removably mounted in connection with the hollow members 16.

Figure 5:
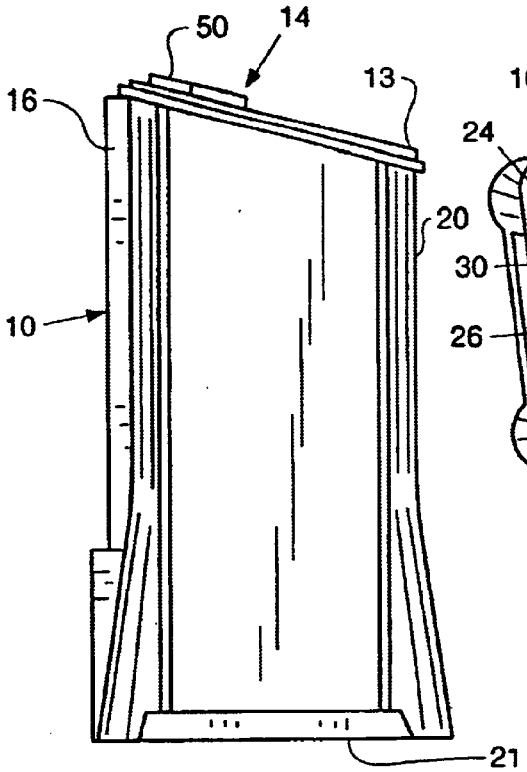
FIG. 5 is a side elevational view of the display unit of FIG. 1.

FIG. 5 is a side elevational view of the display unit 10 showing the construction of both side reinforcing member 21 and tubular member 16. Preferably member 16 extends along a substantial portion of the full vertical length of the product merchandising unit 10 at the rear portion thereof as better shown in FIG. 3. Although, lid member 13 can be hingeably connected to the outer body member 20 so that the lid member 13 can be repeatedly opened for product removal, FIGS. 1–5 illustrate the lid member 13 in a snap-on configuration wherein the opening 12 allows both viewing of the products positioned within the unit as well as an access opening enabling a consumer to reach into the unit 10 to remove product therefrom. Any suitable means for holding lid member 13 in position on top of unit 10 can be utilized.

FIG. 6 is a top plan view looking into unit 10 and into the tub member 24 associated therewith. The tub member 24 is preferably a one-piece member and includes a lower bottom wall or floor member 28, an opposite open upper end portion, and continuous sidewall portions 26 extending therebetween defining an internal cavity as best shown in FIGS. 10 and 11. The tub sidewall portions 26 have an inner surface which tapers downwardly to floor member 28 for conducting any liquid from melting ice which may accumulate in the tub cavity to suitable receiving means as will be hereinafter further explained. The tapered or funneled shape of the sidewalls 26 enables any waste water accumulated within the reservoir portion to flow unrestrictedly to the drain opening 32 extending through floor member 28 for removal from the tub cavity. The drain opening 32 is provided to facilitate draining of the inner tub member 24 when, for example, waste water from melted ice accumulates in the bottom thereof. In this regard, bottom floor member 28 may be tapered or sloped towards drain opening 32 to further facilitate removal of the waste water.

The upper end portion of tub member 24 includes a top rim portion 34 and a downturned flange portion extending therearound, the rim portion 34 forming an outer rim adapted to be supported by the upper edge portion 36 of the outer body member 20 when the tub member 24 is positioned within the body member 20. The tub member 24 is shaped and dimensioned so as to fit within the outer body member 20 and is suspended therein from the top edge portion 36 of the outer body member 20 by rim portion 34. It is also recognized that top rim portion 34 of tub member 24 could be integrally formed with the upper edge portion 36 of the outer body member 20 so as to form a one piece structure between members 20 and 24. It is also recognized that the interior cavity structure associated with tub member 24 can take on a wide variety of different configurations depending upon the configuration of outer body member 20.

The sidewall portions 26 associate with tub member 24 likewise include a plurality of divider retaining slots 37 which are positioned in corresponding relationship on at least two opposed side wall portions 26 for receiving divider members (not shown) for segregating the usable internal tub cavity into separate product holding compartments if so desired. The slots 37 are optionally provided to facilitate dividing the internal tub cavity area for displaying products therewithin. In the particular embodiment illustrated herein, divider members (not shown) can be placed within the cavity of tub member 24 to vertically divide the product display space in order to segregate products displayed therein, for example, to separate fruit juice products from soft drink products. It is also recognized and anticipated that divider retaining slots could likewise be associated with the opposite opposed side wall portions of the tub cavity to optionally segregate such cavity in that direction.

Figure 8:
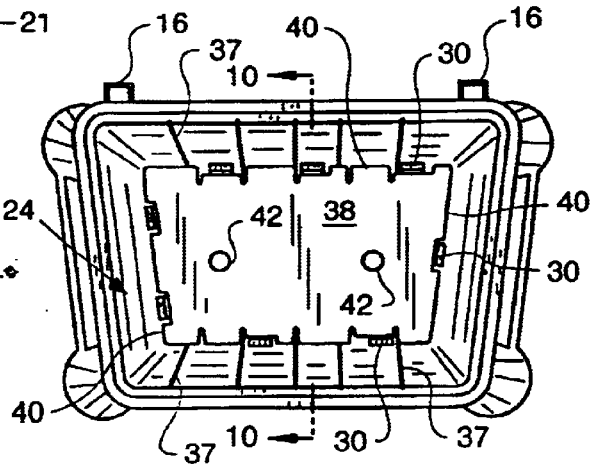
FIG. 8 is a top plan view of the display unit of FIG. 1 showing the interior floor member installed in a lower position.

Importantly, the sidewalls of tub member 24 include a plurality of generally planar upwardly facing shoulder portions or steps 30 located adjacent the inner surface thereof at regularly spaced and offset locations around the internal cavity as best shown in FIGS. 6 and 8. Shoulder portions 30 are important as they are adapted for selectably supporting and positioning the removably insertable floor member 38 at different vertically spaced locations within the internal cavity of the tub member 24 intermediate the bottom wall 28 and the open upper end portion thereof.

Figure 7:
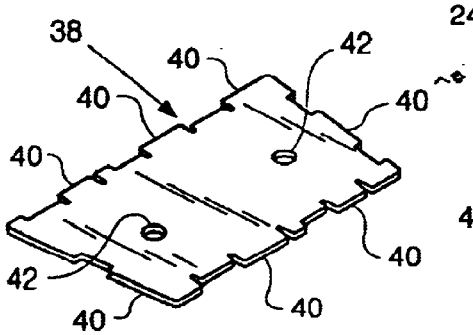
FIG. 7 is a perspective view of an interior floor member used in conjunction with the display unit of FIG. 1.

FIG. 7 is a perspective view of one embodiment of an interior floor member 38 made in accordance with the teachings of the present invention. The removably adjustable floor member 38 includes a substantially flat planar member of substantially trapezoidal configuration having a top surface, an opposite bottom surface, and an outer peripheral edge portion having a plurality of ears or peripheral edge portions 40 associated therewith. The shoulder portions 30 are provided in a configuration corresponding to the projections or ears 40 associated with the floor member 38. Movement of the floor member 38 into engagement with the shoulder portions 30 is easily accomplished by simply inverting the floor member 38 so as to align the peripheral edge portions 40 to either pass by or be supported by the shoulder portions 30. In this regard, the shoulder portions 30 associated with each pair of opposed sidewall portions 26 are spaced and offset from each other as illustrated in FIGS. 6 and 8 and such shoulder portions 30 are located at different heights along the vertical length of such opposed sidewalls. This vertical spaced difference between the positioning and location of the shoulder portions 30 associated with opposed tub sidewalls 26 is best illustrated in FIGS. 10 and 11. The floor member 38 resets upon the shoulder portions 30 at one of the vertically spaced locations when one of the top or bottom floor surfaces is facing upward towards the top end portion of the tub member 24 such as the upper location illustrated in FIGS. 9 and 11, and it rests upon the shoulder portions 30 at another of the vertically spaced locations when the other opposed top or bottom floor surface is facing upward towards the top end portion of the tub member 24 such as the lower location illustrated in FIGS. 8 and 11. While the described exemplary embodiment is shown as having just two selected tub cavity positions, namely, an upper and lower level, it is recognized and anticipated that any number of corresponding tub shoulder portions and floor ear portions may be utilized to form any number of product capacity levels within the interior tub cavity.

When the floor member 38 is positioned within the internal cavity of the tub member 24 with a quantity of ice and articles for sale thereon, it is desired for any melt water from the ice to be able to travel around or through the floor member 38 so as to be able to accumulate in the lower portion of the internal cavity. In effect, the floor member 38 divides the tub member 24 into a product holding portion thereabove and a reservoir portion located therebelow. To facilitate removal of the waste water from the product holding portion of the tub member 24, floor member 38 includes one or more holes 42 extending therethrough, which holes 42 can also be utilized for grasping and holding the floor member 38 to install and remove it from the tub cavity. Waste water can also drain along the perimeter of the floor member 38 between the edges of the floor member 38 located between the peripheral portions 40 and the tub member 24.

FIG. 8 is a top plan view of the inner tub member 24 showing the interior floor member 38 installed in the lower product capacity position. The floor member 38 is oriented such that the projections or ears 40 pass freely around an upper set of the steps or shoulder portions 30 within the tub member 34 and rest upon the lower set of shoulder portions 30. In this way, the floor member 38 is positioned into a lower position within the tub member 24 to allow for greater product carrying therewithin. This orientation is advantageous, for example, in times of high product demand. The holes 42 in the floor member 38 are advantageously provided to facilitate the draining of waste water through the floor member 38.

Figure 9:
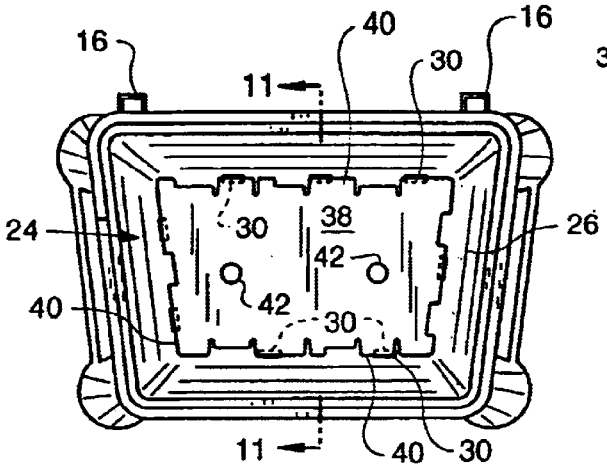
FIG. 9 is a top plan view of the display unit of FIG. 1 showing the interior floor member installed in an upper position.

FIG. 9 is a top plan view of the inner tub member 24 showing the interior floor member 38 installed in the upper product capacity position. In this orientation, the floor member 38 is oriented such that the projections or ears 40 are supported by the upper set of the steps or shoulder portions 30 within the tub member 24. In this way, the floor member 38 is positioned into an upper position within the tub member 24 to allow for a reduced product carrying capacity. This orientation is advantageous, for example, in times of reduced traffic or reduced product demand. As described in connection with FIG. 8, the holes 42 extending through the floor member 38 are advantageously provided to facilitate the draining of waste water through the floor member 38 to bottom drain opening 32.

FIG. 10 is a sectional side elevational view of the display unit 10 showing the interior floor member 38 installed in its lower product capacity position. When viewed from the side, shoulder portions 30 are located to facilitate selectably engaging floor member 38 in at least two different levels so that the usable product display volume of tub member 24 can be accordingly varied. With the floor member 38 in its lower position, the peripheral edge portions or ears 40 as best seen in FIG. 8 pass by the upper level shoulder portions 30 allowing for a greater product and ice carrying capacity. Reservoir 46 located below the floor member 38 is adapted to store waste water from melting ice until it can be drained in connection with drain hose 44. In this regard, one end portion of the drain hose 44 is connected to the drain opening 32 whereas the opposite end portion of drain hose 44 is connected to drain apparatus 22 (FIG. 11).

FIG. 11 is a sectional side elevational view of the display unit 10 showing the interior floor member 38 installed in its upper product capacity position. Here, the peripheral edge portions or ears 40 of floor member 38 are supported by the upper level shoulder portions 30. In this orientation of the floor member 38, the product carrying capacity of tub member 34 is less than that illustrated in connection with FIG. 10. As a result, a smaller amount of ice and product is used to nevertheless position the product in an attractive position near the top rim portion 34 of tub member 24. Reduced product area in times of lower consumer traffic or lower demand has the advantage, among other advantages, of being more cost effective.

In the embodiment illustrated in FIGS. 10 and 11, drain hose 44 is adapted to be extended through the outer body member 20 to the exterior thereof to facilitate draining of the tub reservoir 46. In one embodiment, the drain hose 44 is coiled up inside the outer body member 20 and below the tub member 24 until such time as it becomes desirable to extend the drain hose 44 outside of the outer body member 20 as shown in FIG. 11 to drain the reservoir 46 into a floor drain, a bucket, or other drain means. The drain apparatus or coupling 22 may include a stop member 54 which is engageable with the drain apparatus 22 to prevent waste water from accidentally exiting drain hose 44 until desired.

Figure 12:
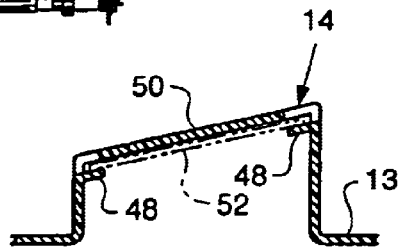
FIG. 12 is a sectional side elevational view of an optional graphic panel display holder constructed in accordance with the teachings of the present invention.

FIG. 12 is a sectional side elevational view of an optional display holder 14 associated with lid member 13 and constructed in accordance with the teachings of the present invention. The display holder 14 includes a plurality of spaced pairs of retaining projections 48 that are adapted to hold and support a graphic panel or printed card 52 when slidably positioned between the respective pairs of retaining projections 48 and the top surface portion 50 of holder 14. The graphic panel or printed card 52 includes advertisement content or other indicia to advertise and promote the products positioned within the unit 10 and any number of such panels or cards 52 can be inserted between the underside portion of the top surface portion 50 of the display holder 14 and the upper portions of the retaining projections 48. In this regard, the top portion 50 of display holder 14 is made of a see-through material so that the indicia or advertising content displayed on panel 52 can be viewed by a consumer.

Thus, there has been shown and described several embodiments of a product merchandising unit having a selectable product capacity, which embodiments fulfill all of the objects and advantages sough therefor. Many changes, modifications, variations and other uses and applications of the present product merchandising units will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A container assembly having a selectable product capacity comprising:

a receptacle having an internal cavity adaptable for holding products positioned therein, said receptacle including a first end portion having a trapezoidally shaped opening communicating with said internal cavity, an opposed second end portion forming the bottom wall of said cavity, and sidewall portions extending around said cavity between said first and second receptacle end portions;

a removably adjustable floor member selectably positionable within the internal cavity of said receptacle proximate to at least two spaced locations therewithin intermediate said first and second receptacle end portions, said floor member being adaptable for holding and supporting products positioned thereon and being further sized and shaped so as to be maneuverable into a substantially flat supportive position at each of said at least two spaced locations within said internal cavity;

a plurality of shoulder portions positioned at each of said at least two spaced locations within said internal cavity, the shoulder portions located at each of said at least two spaced locations being respectively sized and shaped so as to engage peripheral edge portions of said floor member when said floor member is oriented into a substantially flat supportive position adjacent each of the shoulder portions, the shoulder portions located at a first of said at least two spaced locations within said internal cavity being laterally offset with respect to the shoulder portions located at a second of said at least two spaced locations within said internal cavity, at least some of the peripheral edge portions of said floor member engaging the shoulder portions located at a first of said at least two spaced locations in one orientation and at least some of the peripheral edge portions of said floor member engaging the shoulder portions located at a second of said at least two spaced locations in a second orientation and a lid member attachable to said container assembly, said lid member having a product display holder associated therewith operable to receive and retain a display panel having indicia thereon viewable through said lid member.

2. The container assembly defined in claim 1 wherein the internal cavity of said receptacle is adapted for holding chilled products and ice and includes means for draining any accumulated water formed therein.

3. The container assembly defined in claim 1 wherein said product display holder includes a plurality of spaced pairs of retaining projections positioned adjacent an inner surface of said lid member, the display panel being slidably positionable between said plurality of spaced pairs of retaining projections and the inner surface of said lid member.

4. The container assembly defined in claim 1 further including at least one member attachable to said container assembly for supporting a promotional display above said container assembly, the promotional display having means associated therewith engageable with said at least one member.

5. The container assembly defined in claim 1 wherein said receptacle includes at least one vertically oriented divider slot operable to receive a divider member for dividing the internal cavity into at least two compartments.

6. A product merchandising unit for holding and displaying products comprising:

a tub member having opposed top and bottom end portions and sidewall portions extending therebetween defining a tub cavity for holding products positioned therein, said top end portion being trapezoidally shaped and open to provide access to said tub cavity, said sidewall portions including a plurality of shoulder portions located at spaced locations around said tub cavity at two vertically spaced locations therewithin;

a floor member selectably positionable within said tub cavity at locations corresponding to each of said two vertically spaced locations for holding and supporting products positioned thereon, said floor member having two opposed surfaces and including a plurality of spaced peripheral edge portions positioned and located so as to mate with and rest upon respective shoulder portions at said two vertically spaced locations within said tub cavity, said floor member resting upon the shoulder portions at one of said vertically spaced locations when one of said floor surfaces is facing upward towards the top end portion of said tub member, and said floor member resting upon the shoulder portions at the other of said two vertically spaced locations when the other of said floor surfaces is facing upward towards the top end portion of said tub member; and a lid member attachable to the top end portion of said tub member, said lid member including a plurality of spaced pairs of retaining projections positionable adjacent an inner surface of said lid member, said retaining projections being adapted to receive and retain at least one promotional display card for promoting the products displayed in said tub member, said at least one display card being visible to a consumer viewing said lid member.

7. The product merchandising unit defined in claim 6 wherein said tub member is adaptable for holding chilled products and ice and includes means for draining any accumulated water formed therein.

8. The product merchandising unit defined in claim 6 wherein said tub member includes at least one vertically oriented divider slot operable to receive a divider member for dividing the tub cavity into at least two compartments.

9. The product merchandising unit defined in claim 6 wherein said tub member includes a plurality of vertically oriented divider slots operable to receive divider members for dividing the tub cavity into a plurality of segregated compartments.

10. The product merchandising unit defined in claim 6 wherein said product merchandising unit includes a plurality of wheels.

11. The product merchandising unit defined in claim 10 wherein at least some of said wheels are casters.

12. The product merchandising unit defined in claim 6 wherein said floor member includes means to allow the passage of water from above said floor member to an area located below said floor member.

13. The product merchandising unit defined in claim 6 wherein said floor member includes at least one drain opening operable to enable waste water to drain therethrough.

14. The product merchandising unit defined in claim 6 further including at least one tubular member for supporting a vertical display parallel to a rear side wall of said product merchandising unit and above said tub member.

15. A product merchandising unit for holding and displaying products comprising:

a receptacle having opposed top and bottom end portions and side wall portions extending therebetween defining an internal cavity for holding products positioned therein, said top end portion being trapezoidally shaped and open to provide access to said internal cavity, said side wall portions including a plurality of shoulder portions located at spaced locations around said internal cavity at at least two vertically spaced locations therewithin;

a removably adjustable floor member selectively positionable within said internal cavity at locations corresponding to each of said at least two vertically spaced locations for holding and supporting products positioned thereon, said floor member having top and bottom floor surfaces and including a plurality of spaced peripheral edge portions positioned and located so as to mate with and rest upon respective shoulder portions at said at least two vertically spaced locations within said internal cavity, at least some of said peripheral floor edge portions engaging at least some of said shoulder portions at one of said at least two vertically spaced locations within said internal cavity when the top floor surface is positioned in a substantially flat supportive position for holding products thereon, at least some of said peripheral floor edge portions engaging at least some of said shoulder portions located at a second of said at least two vertically spaced locations within said internal cavity when the bottom floor surface is positioned in a substantially flat supportive position for holding products thereon;

said receptacle being positioned and located within an outside body member having opposed top and bottom end portions and side wall portions extending therebetween, the top end portion of said outside body member being trapezoidally shaped so as to conform to the top end portion of said receptacle; and a lid member attachable to said product merchandising unit adjacent the top end portion of said receptacle, said lid member including a plurality of spaced pairs of retaining projections positioned adjacent a top portion of said lid member operable to receive and retain a display panel having indicia thereon, the display panel being slidably positionable between said plurality of spaced pairs of retaining projections and the top portion of said lid member, the display panel being viewable through the top portion of said lid member.

16. The product merchandising unit defined in claim 15 further including a pair of members attachable to said outer body member for supporting a promotional display above said product merchandising unit, the promotional display having means associated therewith engageable with said pair of members.

* * * * *